United States Patent [19]

Stanton

[11] Patent Number: 4,717,040

[45] Date of Patent: Jan. 5, 1988

[54] ROTATIONALLY MOULDED SEPTIC TANK SLEEVES

[75] Inventor: William H. Stanton, Winnipeg, Canada

[73] Assignee: Equinox Industries Ltd., Winnipeg, Canada

[21] Appl. No.: 38,758

[22] Filed: Apr. 15, 1987

[51] Int. Cl.[4] ..... B65D 41/16; B65D 41/18

[52] U.S. Cl. ..... 220/306; 220/266

[58] Field of Search ..... 220/266, 306

[56] References Cited

U.S. PATENT DOCUMENTS 3,198,375 8/1965 Hunter ..... 220/306

3,823,843 7/1974 Stephens et al. ..... 220/306

*Primary Examiner*—George T. Hall

*Attorney, Agent, or Firm*—Ciotti & Murashige, Irell & Manella

[57] ABSTRACT

A one-piece or sectional access sleeve for septic tanks is rotationally moulded as a single tube with covers formed at one or both ends. These covers are parted-off and trimmed and engage the upper open end of the sleeve in sealed, twist-locking relationship. In the sectional sleeve, portions or sections can be parted off at specific locations along the length thereof and can either receive covers as mentioned above or can be engaged upon the upper end of another section and twist-locked into sealing relationship so that the necessary length of access sleeve is easily assembled for field attachment and access to the tank, from the surface, regardless of the depth of the tank below the ground surface.

17 Claims, 12 Drawing Figures

ROTATIONALLY MOULDED SEPTIC TANK SLEEVES

BACKGROUND OF THE INVENTION

This invention relates to new and useful improvements in rotationally moulded septic tank sleeves.

Septic tanks are normally buried some two to seven feet below grade depending upon conditions and from time to time it is necessary to enter a tank to remove accumulated solids or sludge, or to service liquid level controls.

To this end, a septic tank manhole access sleeve is normally provided and formed by joining together as by bolts, screws, bonding, or the like, the appropriate number of moulded fibreglass sleeve sections, flanged at the ends thereof, in order to achieve the desired manway length. An adapter collar is then bolted or bonded to the lower end thereof and attached to the tank body over the manhole with screws or the like just prior to installing the tank into the ground after which the hole is then backfilled and tamped down.

This results in a fibreglass-lined, 24" manway protected by a moulded fibreglass lid which is attached with sheetmetal screws to the flange of the uppermost sleeve. The lid or cover may be fitted with an 8" service lid in the center thus providing a "childproof" cover system that prevents children from casually removing the main cover and falling into the tank.

This system is labour-intensive to produce and assembly. The sleeves are relatively expensive because they are produced by the hand-lay up process and hand assembled. Also in order to achieve the required strength in the fibreglass, the price is increased to a point where the product is non-competitive.

The present invention overcomes these disadvantages by providing an access sleeve produced by rotationally moulding the sleeve from a synthetic plastic such as low density polyethylene. As an example, these sleeves may be produced in a 5-foot, one-piece sleeve or, alternatively, a 5-foot, one-piece but sectional sleeve.

The moulds are designed so that a lid may be moulded on either end of the sleeve body and the lid may be cut off at a parting-off line from the finished sleeve and trimmed so that it drops down over means on the sleeve body which, in cooperation with corresponding means on the lid, may be twist-locked into position thus sealing the cover and lid securely to the body of the sleeve.

In the case of the sectional sleeve, they may be parted off at predetermined positions and assembled onto other sections to creats a variety of lengths including sections which may be added to the one-piece sleeve to create an extra-deep manway. Of importance is the sealing lip that is created when the cover is parted off from the body which ensures a tight fit between the cover and body or body sections and prevents seepage of ground water into the tank.

The cover may be fitted with an 8" service access as is conventional and screws may detachably secure the cover to the body to prevent an authorized removal thereof.

In accordance with this invention there is provided an access sleeve for septic tanks and the like comprising in combination a rotationally moulded cylindrical sleeve, a cover portion moulded integrally upon at least one end of said sleeve, an annular parting-off line formed between said cover portion and said one end of said sleeve whereby said cover can be removed after moulding, and means on said one end of said sleeve cooperating with means on said cover for detachably securing said cover to said one end in sealing relationship therewith after said cover has been parted off from said sleeve.

A further advantage of the invention is to provide access sleeves which include a moulded collar that may be trimmed to adapt same to a variety of tank sizes with the collar being secured to the tank by means of rubber bolts which are conventional in attaching plastic or fibreglass parts together.

A further advantage of the invention is to provide a device of the character herewithin described which is extremely simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which;

DESCRIPTION OF THE DRAWINGS

In the drawings like characters of reference indicate corresponding parts in the different figures.

DETAILED DESCRIPTION

Figure 1:
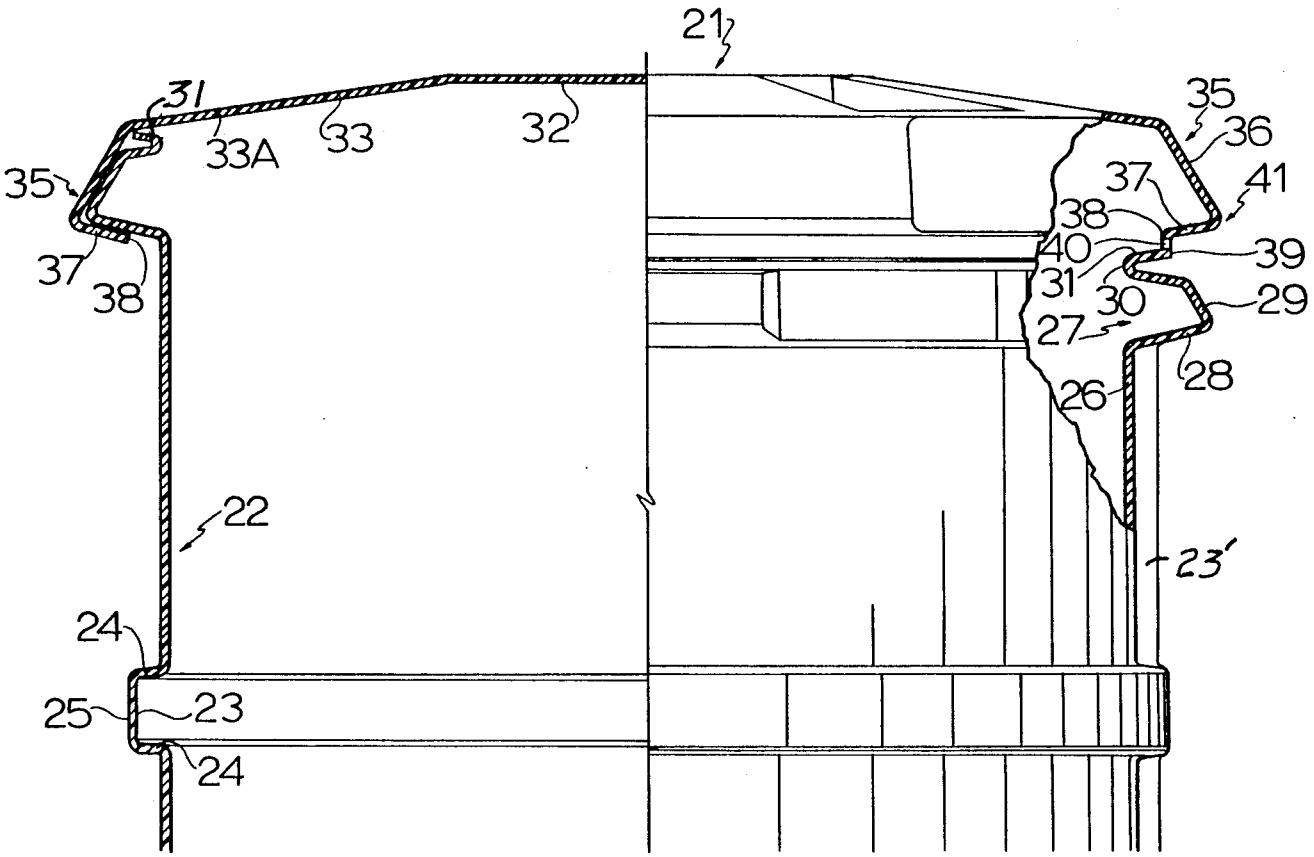
FIG. 1 is a partially sectioned fragmentary view of the upper end of an access sleeve with one side showing the cover formed integrally with the sleeve and the other side showing the cover parted off and twist-lock engaged with the sleeve substantially along the line 1—1 of FIG. 2.
Figure 3:
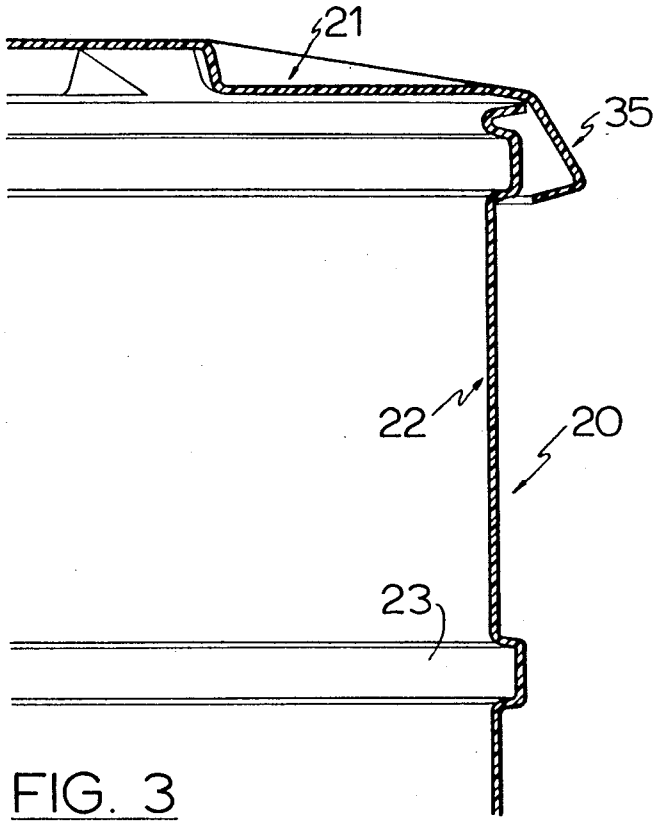
FIG. 3 is a fragmentary section along the line 3—3 of FIG. 2.
Figure 2:
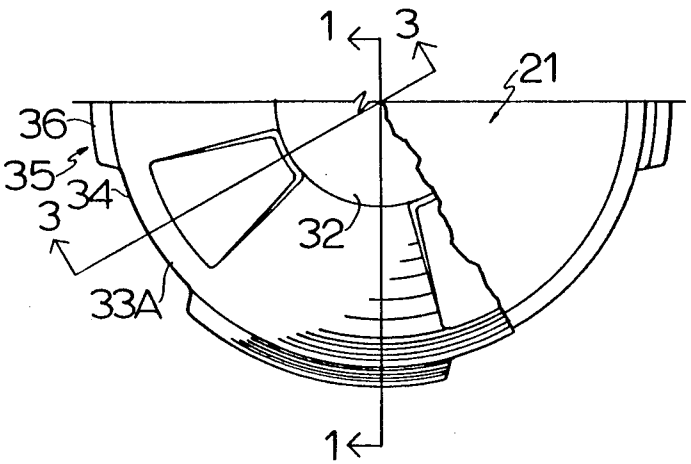
FIG. 2 is a fragmentary top plan view of FIG. 1.
Figure 5:
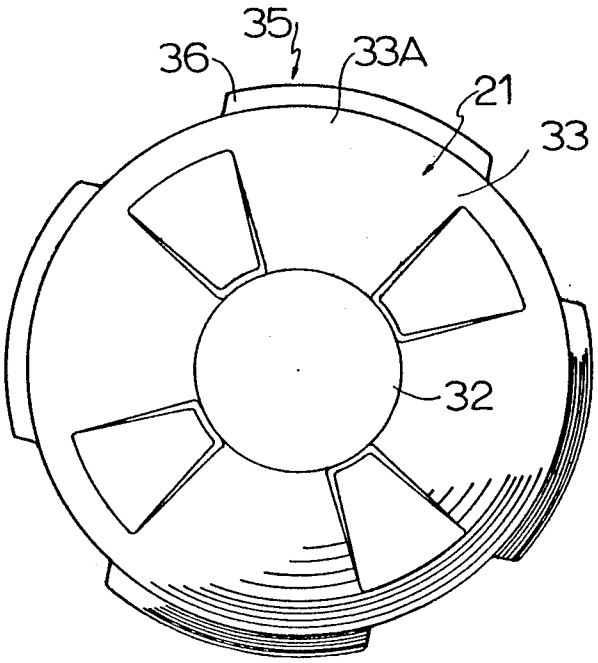
FIG. 5 is a top plan view of the cover per se.
Figure 4:
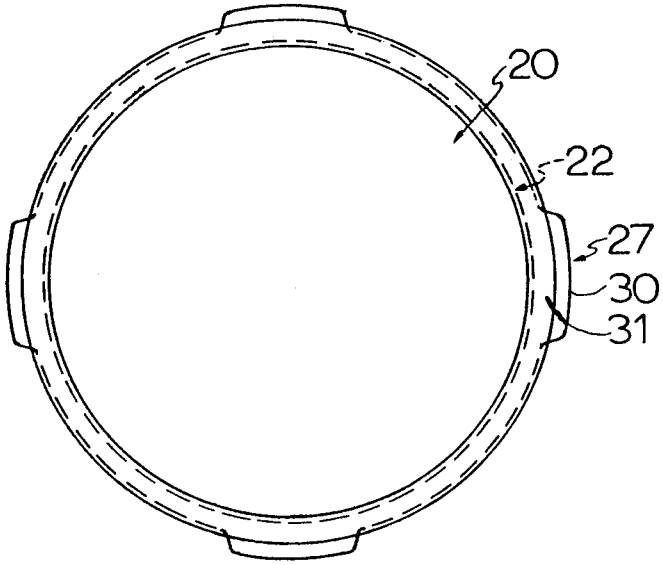
FIG. 4 is a top plan view of the sleeve with the cover removed.
Figure 12:
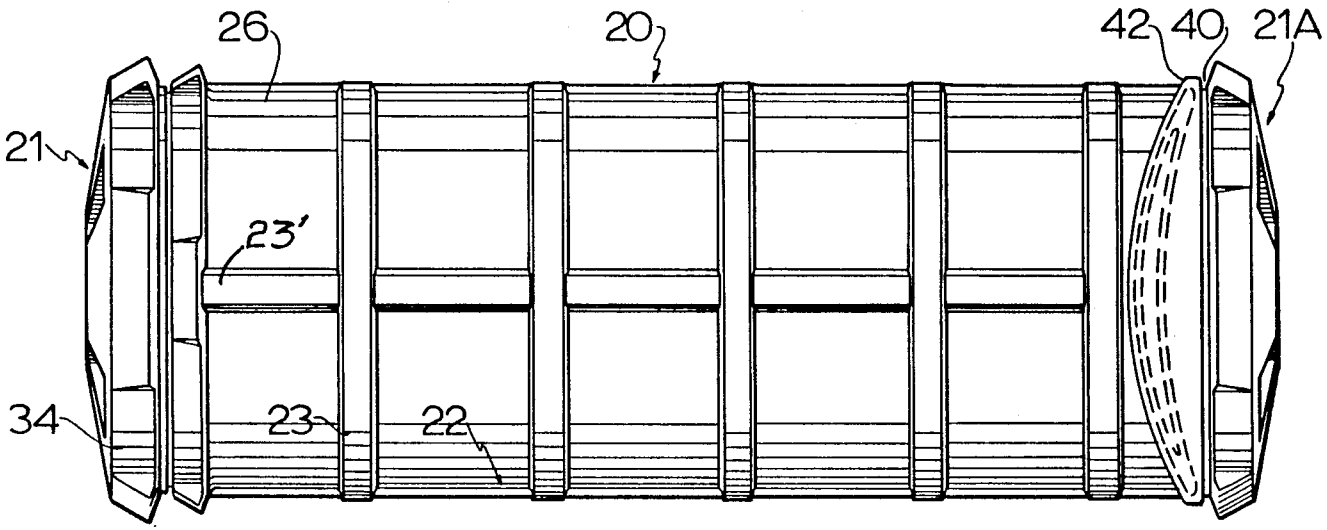
FIG. 12 is a side elevation of a one-piece access sleeve.

Proceeding therefore to describe the invention, reference should first be made to FIGS. 1 and 12 with FIG. 12 showing a one-piece sleeve assembly collectively designated 20 and FIG. 1 showing one end thereof with details of the formation of the cover collectively designated 21 both attached and detached from the sleeve body collectively designated 22.

The sleeve body and cover is rotationally formed in a conventional manner with the body including a plurality of spaced and parallel annular reinforcing ribs 23 being formed therein, said ribs being shown in cross section in FIG. 1 and including the out-turned flanges 24 with the vertical wall 25 extending therebetween and these annular flanges are preferably spaced equidistantly along the length of the sleeve body 22. Vertical reinforcing flange or stiffeners 23' extend between adjacent annular flanges spaced radially around the body 22.

On one end 26 of the sleeve body 22, there is formed a plurality of offstanding projections collectively designated 27 shown in detail in FIG. 1. These are preferably equidistantly spaced around the periphery of the upper end 26 and include a lower out-turned lug-engaging surface 28, a wall portion 29 extending upwardly and inwardly therefrom and a counter-angulated in-turned sealing flange surface 30 including the upper cover engaging portions 31 which extend as an upper annular flange all around the upper end of the body 22.

These projections extend radially outwardly from the upper end of the wall 22 and are identified as a set of lug-engaging projections.

Figures 9, 10, 11:
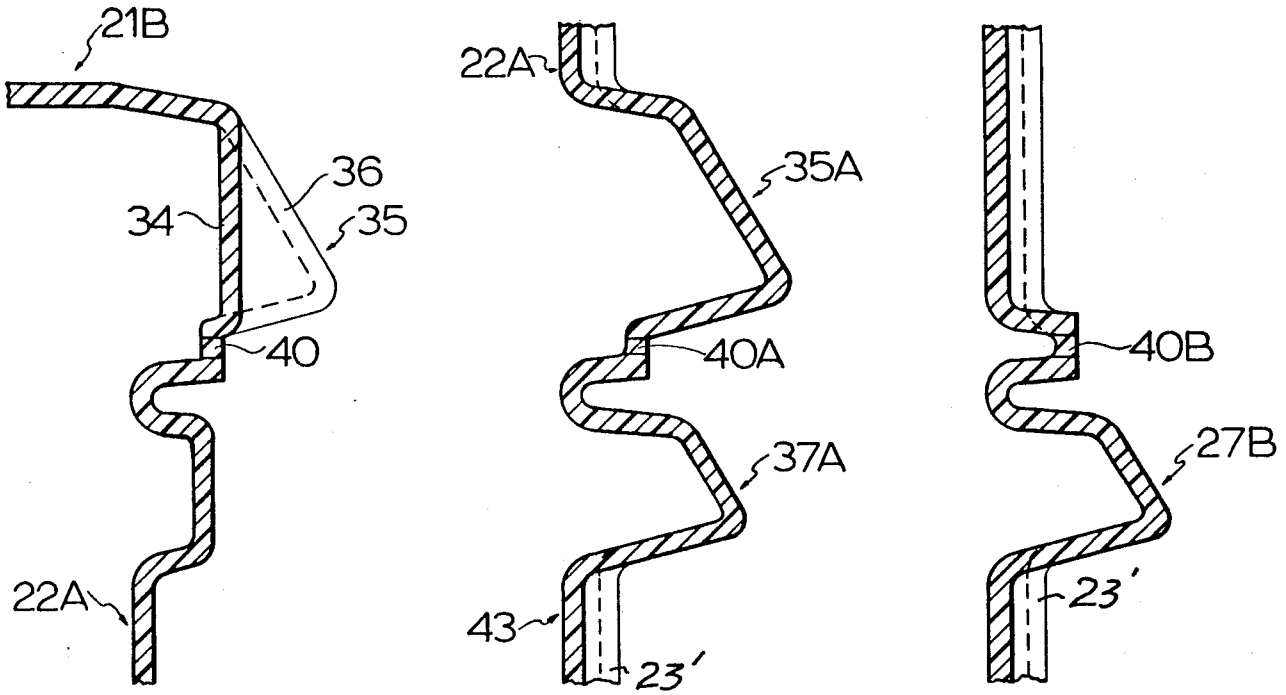
FIG. 9 is a fragmentary section along the line 9—9 of FIG. 7.
FIG. 10 is a fragmentary cross sectional view substantially along the line 10—10 of FIG. 6.
FIG. 11 is a fragmentary sectional view substantially along the line 11—11 of FIG. 6.

The lid or cover 21 includes the centrally located planar surface 32 surrounded by an outwardly and downwardly inclined portion 33, and a substantially vertical rim 34 (see FIGS. 9 and 12).

A set of lugs collectively designated 35 are formed around the rim and extend outwardly therefrom and include an outwardly and downwardly extending wall portion 36 and an in-turned flange 37 extending inwardly and downwardly from the lower edge of these wall portions 35.

On the right hand side of FIG. 1 and shown in section, it will be noted that the inner edge 38 of the flange 37 is joined to the outer edge 39 of the portion 31 of the lug by a vertical parting-off portion which, after the assembly has been formed, may be parted off by a parting-off trimming bit and guide shown schematically in FIG. 1 by reference character 41. This not only severs the cover 21 from the upper end 26 of the sleeve wall 22 but also removes this vertical portion 40 and trims the two edges as shown on the left hand side of FIG. 1.

With further trimming to accommodate the lugs 35, the lid may then be detachably secured in sealing relationship to the upper end 26 of the sleeve by engaging the lid or cover over the upper and so that the lugs 35 engage the outer surface of the wall 22 between adjacent projections 27 and then rotating the cover in either direction, approximately ¼ turn so that the flanges 37 of the lugs engage under the sloping walls 28 of the projections and the annular flange 31 engages the inner wall 33A of the outer edge of the sloping portion 33 of the cover as clearly shown in the left hand side of FIG. 1, it being understood that the slight resiliency present in plastic rotational moulding configurations permits the lid or cover to be moved downwardly slightly so that the flanges 37 can engage under the portions 28 by compressing the portions of the sealing flange surfaces 30. This not only retains the cover frictionally in position with slight upward tension to the cover but also ensures a relatively good seal between the cover and the upper end of the wall.

Reference to FIG. 12 will show a tank wall engaging flange 42 formed on the other end of the sleeve 20. This is an arcuately curved flange extending radially outwardly from the wall 22 and may be trimmed by means of jigs (not illustrated) to engage over the curved surface of the wall of the associated septic tank (not illustrated). It may be secured thereto by rubber bolts or the like in a conventional manner.

Also, means are provided on the mould of the embodiment shown in FIGS. 1 and 12 to form a further cover assembly collectively designated 21A if desired, which of course may be parted off along the parting-off line 40 as hereinbefore described, it being understood that the configuration of this cover 21A is the same as that hereinbefore described relative to the cover 21.

Figure 6:
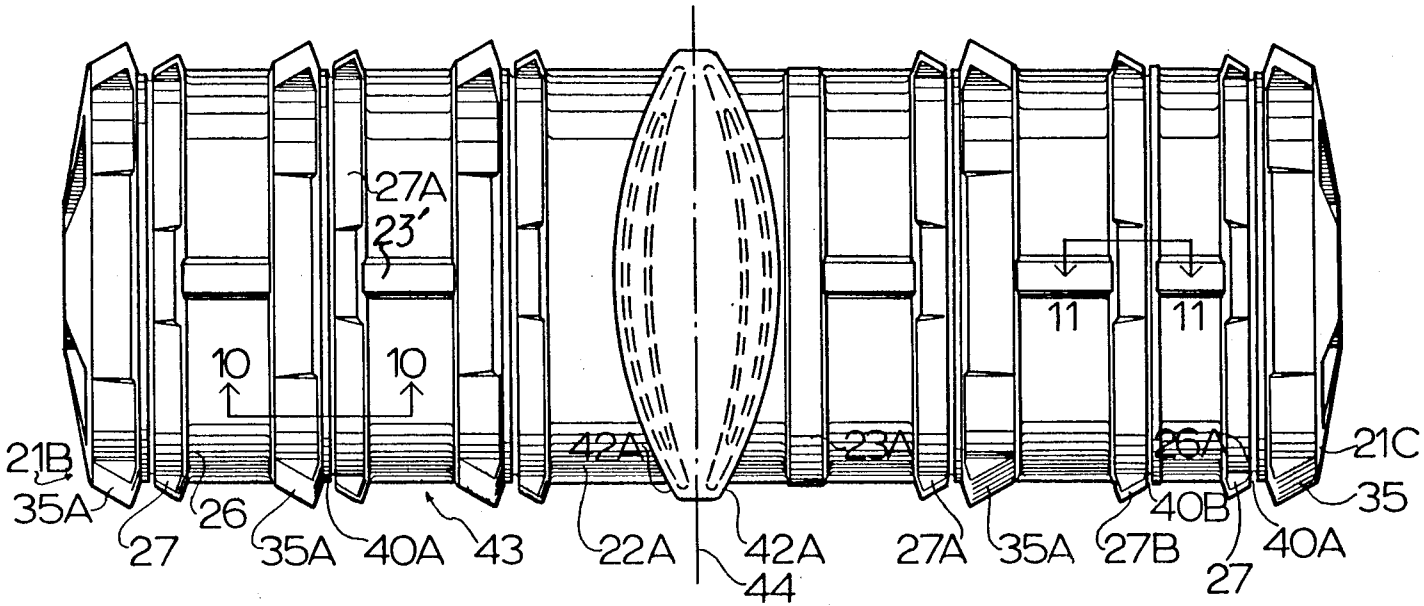
FIG. 6 is a side elevation of a combination type sleeve.
Figure 8:
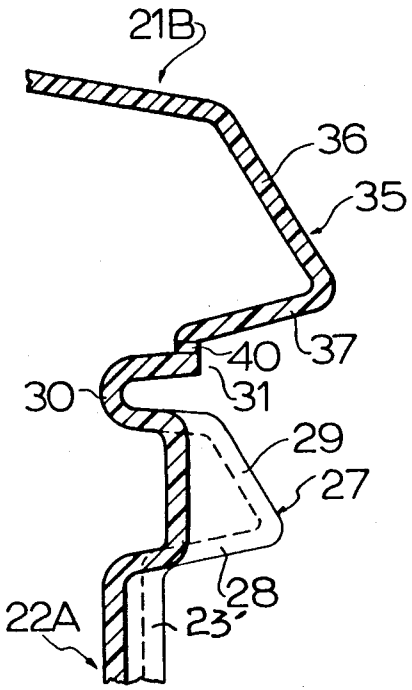
FIG. 8 is a fragmentary section along the line 8—8 of FIG. 7.
Figure 7:
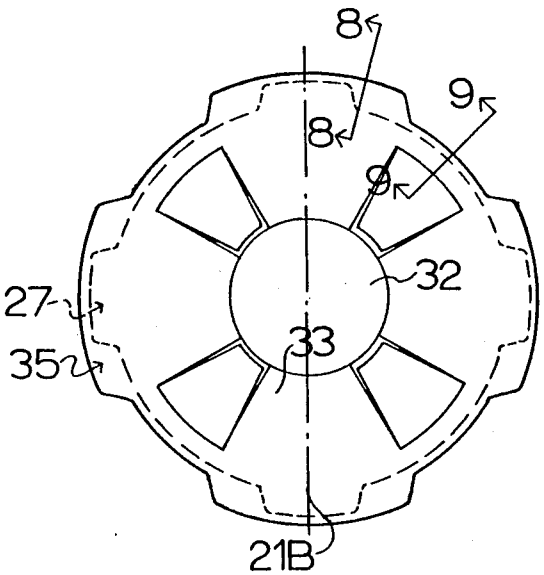
FIG. 7 is an end view of FIG. 6.

Reference should next be made to FIGS. 6 and 11 which shows what is termed a sectional sleeve assembly and where applicable, similar reference characters are used.

This embodiment includes a cylindrical rotationally moulded sleeve assembly collectively designated 43 comprising a cylindrical body 22A having covers 21B and 21C formed integrally upon either end, together with a set of lugs 35A around the periphery and a corresponding set of projections 27 formed around the upper side or end 26 of the body 22A.

Also formed around the transverse centre line 44 of the sleeve assembly is a pair of oppositely facing tank attaching flanges 42A similar to flanges 42 hereinbefore described so that when parted off along the transverse axis 44, after forming, these flanges may be trimmed to suit the curved wall of the tank to which they are to be secured.

Between each flange 42A and the corresponding cover 21B or 21C, further sets of lugs 35A are formed extending radially outwardly from the wall 22A, together with corresponding further sets of projections 27A also extending radially outwardly from the wall 22, each corresponding further set of lugs and projections including a parting-off line 40A similar to parting-off line 40 previously described with reference to FIG. 1.

In the embodiment illustrated, two sets of further lugs and projections are shown on one of the wall sections between one flange 42A and the cover 21B and one additional set between the other flange 42A and the cover 21C, the latter section including an annular reinforcing ring 23A adjacent the flange 42A, together with a further set of projections 27B together with a parting-off line 40B being formed between the cover 21C and the further set of lugs and projections 35A and 27A as shown. This means that if the sleeve is parted off at 40B, then an upper open end portion is formed.

Otherwise, the sleeve may be parted off as desired at the parting-off lines 40A between the further adjacent sets of lugs and projections thus providing a plurality of sections which may be joined together by the twist-lock engagement of lugs and projections as hereinbefore described, the length depending upon the depth at which the associated septic tank is to be placed. Further stiffener ribs 23' are also provided and sealing flanges 31B are formed when sections are parted-off.

As an example, if the distance between adjacent sets of lugs and projections is approximately 12 inches and the distance between the parting-off line 40B and the adjacent upper end 26A of the sleeve is approximately 6 inches, then the sectional sleeves may be cut up and assembled into body sections to create a variety of lengths including, for example, a 12", 18", 24", 30", 36", 42" or 60" sleeve. Furthermore, sections can also be added to the 60" one-piece sleeve illustrated in FIG. 12 to create an extra-deep manway. Once again, the sealing lip or in-turned sealing flange surface portions 31, which of course is created when the cover or sections are parted off, ensure a relatively tight fit between the cover and body or body sections thereby preventing seepage of ground water into the tank.

Also, because the lugs are hollow, these together with the hollow annular rings 23A may serve as footholds for ease of agress and exit when servicing is required.

It will therefore be appreciated that there is provided a one-piece or sectional synthetic plastic access sleeve for use with septic tanks, which is readily formed by rotational moulding techniques by a synthetic plastic such as polyethylene of sufficient thickness to produce, together with the design, sufficient strength to resist stresses normally encountered when installing such septic tanks below grade and which furthermore, if desired, is adjustable in assembly to provide the necessary access sleeve length desired.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An access sleeve for septic tanks and the like comprising in combination a rotationally moulded cylindrical sleeve, a cover portion moulded integrally upon at least one end of said sleeve, an annular parting-off line formed between said cover portion and said one end of said sleeve whereby said cover can be removed after moulding, and means on said one end of said sleeve cooperating with means on said cover for detachably securing said cover to said one end in sealing relationship therewith after said cover has been parted off from said sleeve.

2. The access sleeve according to claim 1 which includes a cover formed on either end of said sleeve.

3. The access sleeve according to claim 1 in which said means on said one end of said sleeve cooperating with means on said cover for detachably securing said cover to said one end of said sleeve includes a set of lugs extending downwardly from the periphery of said cover in radially spaced relationship with one another, in-turned flanges on the lower ends of said lugs, a corresponding set of lug-engaging projections extending radially outwardly from the periphery of the wall of said sleeve, said lugs twist-lock engaging said projections.

4. The access sleeve according to claim 3 in which said projections include a lower out-turned lug-engaging surface, a wall portion extending upwardly therefrom and an in-turned sealing flange surface extending inwardly from the upper end of said wall portion, said in-turned flanges of said lugs engaging said lower out-turned lug-engaging surface of said projections and said in-turned sealing flange surface of said projections engaging the inner surface of the periphery of said cover when said lugs are in twist-lock engagement with said projections.

5. The access sleeve according to claim 1 which includes a tank wall securing flange formed on the other end of said sleeve.

6. The access sleeve according to claim 5 which includes a tank wall securing flange formed on the other end of said sleeve.

7. The access sleeve according to claim 4 which includes a tank wall securing flange formed on the other end of said sleeve.

8. The access sleeve according to claim 3 which includes at least one further set of lugs formed around the wall of said sleeve spaced from said first set of lugs and at least one further set of lug-engaging projections formed around the wall of said sleeve adjacent said one further set of lugs and an annular parting-off line formed between said further set of lugs and said further set of lug-engaging projections.

9. The access sleeve according to claim 4 which includes at least one further set of lugs formed around the wall of said sleeve spaced from said first set of lugs and at least one further set of lug-engaging projections formed around the wall of said sleeve adjacent said one further set of lugs and a parting-off line formed between said further set of lugs and said further set of lug-engaging projections.

10. The access sleeve according to claim 5 which includes at least one further set of lugs formed around the wall of said sleeve spaced from said first set of lugs and at least one further set of lug-engaging projections formed around the wall of said sleeve adjacent said one further set of lugs and a parting-off line formed between said further set of lugs and said further set of lug-engaging projections.

11. The access sleeve according to claim 6 which includes at least one further set of lugs formed around the wall of said sleeve spaced from said first set of lugs and at least one further set of lug-engaging projections formed around the wall of said sleeve adjacent said one further set of lugs and a parting-off line formed between said further set of lugs and said further set of lug-engaging projections.

12. The access sleeve according to claim 7 which includes at least one further set of lugs formed around the wall of said sleeve spaced from said first set of lugs and at least one further set of lug-engaging projections formed around the wall of said sleeve adjacent said one further set of lugs and a parting-off line formed between said further set of lugs and said further set of lug-engaging projections.

13. The access sleeve according to claim 8 in which the projections of said further set include a lower out-turned lug-engaging surface, a wall portion extending upwardly therefrom and an in-turned sealing flange surface, said in-turned flanges of said further set of lugs engaging said lower lug-engaging surface of said further projections and said in-turned sealing flange surface of said further projections engaging the inner surface of the periphery of said further set of lugs when said further set of lugs is in twist-lock engagement with said further set of projections.

14. The access sleeve according to claim 7 in which the projections of said further set include a lower out-turned lug-engaging surface, a wall portion extending upwardly therefrom and an in-turned sealing flange surface, said in-turned flanges of said further set of lugs engaging said lower lug-engaging surface of said further projections and said in-turned sealing flange surface of said further projections engaging the inner surface of the periphery of said further set of lugs when said further set of lugs is in twist-lock engagement with said further set of projections.

15. The access sleeve according to claim 8 which includes a cover formed on either end of said sleeve.

16. The access sleeve according to claim 15 which includes a pair of oppositely facing tank wall engaging flanges formed on said sleeve intermediate the ends thereof, and an annular parting-off line therebetween, at least one further set of lugs formed around the wall of said sleeve between each of said tank wall securing flanges and the ends of said sleeve at least one further set of lug-engaging projections formed around the wall of said sleeve adjacent each of said further set of lugs and an annular parting-off line formed between each of said further set of lugs and each of said further set of lug-engaging projections.

17. The access sleeve according to claim 16 in which each of said further set of projections includes a lower out-turned lug-engaging surface, a wall portion extending upwardly therefrom and an in-turned sealing flange surface, each of said in-turned flanges of said further lugs engaging said lower out-turned lug-engaging surface of relevant projections and said in-turned sealing flange surface of said relevant projections engaging the inner surface of the periphery of the relevant lugs when said relevant lugs are in twist-lock engagement with said projections.

* * * * *